US008032068B2

(12) United States Patent
Hanyu et al.

(10) Patent No.: US 8,032,068 B2
(45) Date of Patent: Oct. 4, 2011

(54) FIXING DEVICE AND IMAGE FORMING APPARATUS

(75) Inventors: Naohiko Hanyu, Tokyo (JP); Hidetoshi Katayanagi, Tokyo (JP); Mikihiko Takada, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 409 days.

(21) Appl. No.: 12/370,954

(22) Filed: Feb. 13, 2009

(65) Prior Publication Data

US 2009/0208263 A1 Aug. 20, 2009

(30) Foreign Application Priority Data

Feb. 19, 2008 (JP) ..... 2008-037346

(51) Int. Cl.
*G03G 15/20* (2006.01)

(52) U.S. Cl. ..... 399/329; 399/328

(58) Field of Classification Search ..... 219/216; 399/328, 329

See application file for complete search history.

(56) References Cited

U.S. PATENT DOCUMENTS 7,260,353 B2 * 8/2007 Takemura ..... 399/329
7,457,576 B2 * 11/2008 Takada et al. ..... 399/329

FOREIGN PATENT DOCUMENTS

JP 2002-148970 A 5/2002
JP 2007-79183 A 3/2007

* cited by examiner

*Primary Examiner* — Hoang Ngo
(74) *Attorney, Agent, or Firm* — Cantor Colburn LLP

(57) ABSTRACT

A fixing device includes: a heating section; and a press section which presses the heating section and thereby forms a fixing nip section, wherein at least one of the heating section and the press section comprises, an endless fixing belt; a press member which presses the fixing belt to the fixing nip; and a sliding sheet covering the press member, wherein the sliding sheet is wider than the fixing belt; projections are provided at a first area which is inside of an end part of the press member of a surface of the sliding sheet in the width direction; and projections lower than the projections provided at the first area are provided at a second area which is near the end of the fixing belt of the surface of the sliding sheet, or projections are not provided at all at the second area.

5 Claims, 5 Drawing Sheets

FIXING DEVICE AND IMAGE FORMING APPARATUS

RELATED APPLICATION

This application is based on Japanese Patent Application NO. 2008-037346 filed on Feb. 19, 2008 in Japanese Patent Office, the entire content of which is hereby incorporated by reference.

TECHNICAL FIELD

The present invention relates to fixing devices which fix toner image on a recording sheet by applying heat and pressure, and to image forming apparatuses having such fixing devices.

BACKGROUND OF THE INVENTION

Conventionally, as fixing devices used in image forming apparatuses of the electro-photographic method such as copying machines, printers, facsimiles, and multifunction peripherals provided with all these functions, fixing devices of heat roller type (which may be also called as heat fixing roller type) are widely adopted by from low speed equipments to high speed equipments as well as by from black-and-white equipments to color equipments. The fixing devices of heat roller type apply heat and pressure to recording medium with the toner image to be transferred thereon by gripping and conveying the recording sheet by a fixing nip portion formed by a fixing roller which is maintained in a predetermined range of temperature and a pressure roller that has an elastic layer, applies pressure and contacts to the fixing roller.

By the requirement of recent years for achieving colorization and speeding up, it is required to increase the nip width for fixing in order to effectively heat toner on the surface of the sheet. In order to increase the nip width, it is possible to consider increasing the diameters of the two rollers or increasing the dented (deformed) amount of the roller by increasing the contact force between the two rollers. However, if these measures are employed, problems such that the fixing device becomes big, and the reliability of the fixing device becomes low arise and the design flexibility becomes low.

In order to solve these problems, fixing devices of the belt nip type have been employed in these days that have an endless fixing belt which rotates driven by rollers and a press member which is fixed at a side of an inner peripheral surface of the fixing belt and presses the fixing belt towards the heat roller. Structurally, the width of the nip section of the fixing devices of the belt nip type can be wider than the width of the nip section of the fixing devices of the heat roller type.

Because the fixing devices of the belt nip type are configured that the fixing belt is pressingly contacted to the heat roller by the fixed sliding press member, running of the fixing belt is obstructed and sipping of image and wrinkle of sheet may be caused when the a friction between the fixing belt and the press member.

In order to solve such a problem, in the Unexamined Japanese Patent Application Publications 2002-148970, has been disclosed a fixing device that has a sliding sheet which is a sheet shaped member covering the press member for reducing a sliding friction with the inner surface of the fixing belt between, wherein a large undulation is formed on the inner surface of the sliding sheet, in order to prevent the slipping of image.

However, in the fixing device of the Unexamined Japanese Patent Application Publications 2002-148970, lubricant coated on the inner surface of the fixing belt and releasing agent coated on the surface of the heat roller are feared to seep from an edge to the inner surface of the sliding sheet and stick to the press pad covered by the sliding sheet. In such a case, the press pad swells and transforms by sticking oil such as the releasing agent and a problem is caused that the primary function does not work.

In fixing device of the Unexamined Japanese Patent Application Publication No. 2007-79183, in order to solve such a problem, a protruding section is provided outside of the sliding sheet so that the edge of the protruding section locates outside of the edge of the fixing belt of the fixing roller to prevent the releasing agent from seeping into the inner peripheral surface of the sliding sheet.

However a problem has occurred that the sliding sheet easily tears by wearing of the sliding sheet promoted by a friction between the sliding sheet and the fixing belt because length of the sliding sheet is made longer than the fixing belt by providing the protruding section.

Especially, in the sliding sheet having the large undulation on the surface, contacting with the fixing belt concentrates at the undulation section and therefore the problem that the tear easily occurs at the undulation section is caused.

By taking into considering of the above described problem, one object of the present invention is to provide a fixing device which prevents the sliding sheet from tearing by wearing of the sliding sheet which covers the press member for pressing the inner peripheral surface of the fixing belt.

SUMMARY

One aspect of the present invention is a fixing device comprising:

a heating section; and a press section which presses the heating section and thereby forms a fixing nip section, wherein at least one of the heating section and the press section comprises, an endless fixing belt;

a press member which presses the fixing belt from an inner peripheral surface of the fixing belt to the fixing nip; and a sliding sheet covering the press members wherein the inner peripheral surface of the fixing belt slides on the sliding sheet and an edge part in a width direction of the sliding sheet locates out side of an edge part of the fixing belt in the width direction; a plurality of projections are provided at a first area which is inside of an edge part of the press member in the width direction of a surface of the sliding sheet; and a plurality of projections which are lower than the plurality of the projections provided at the first area are provided at a second area which is near the edge part of the fixing belt of the surface of the sliding sheet, or no projections are provided at the second area.

DESCRIPTION OF THE PREFERRED EMBODIMENT

The present invention will be described based on the preferred embodiments, however the present invention is not construed to be restricted to these embodiments.

Figure 1:
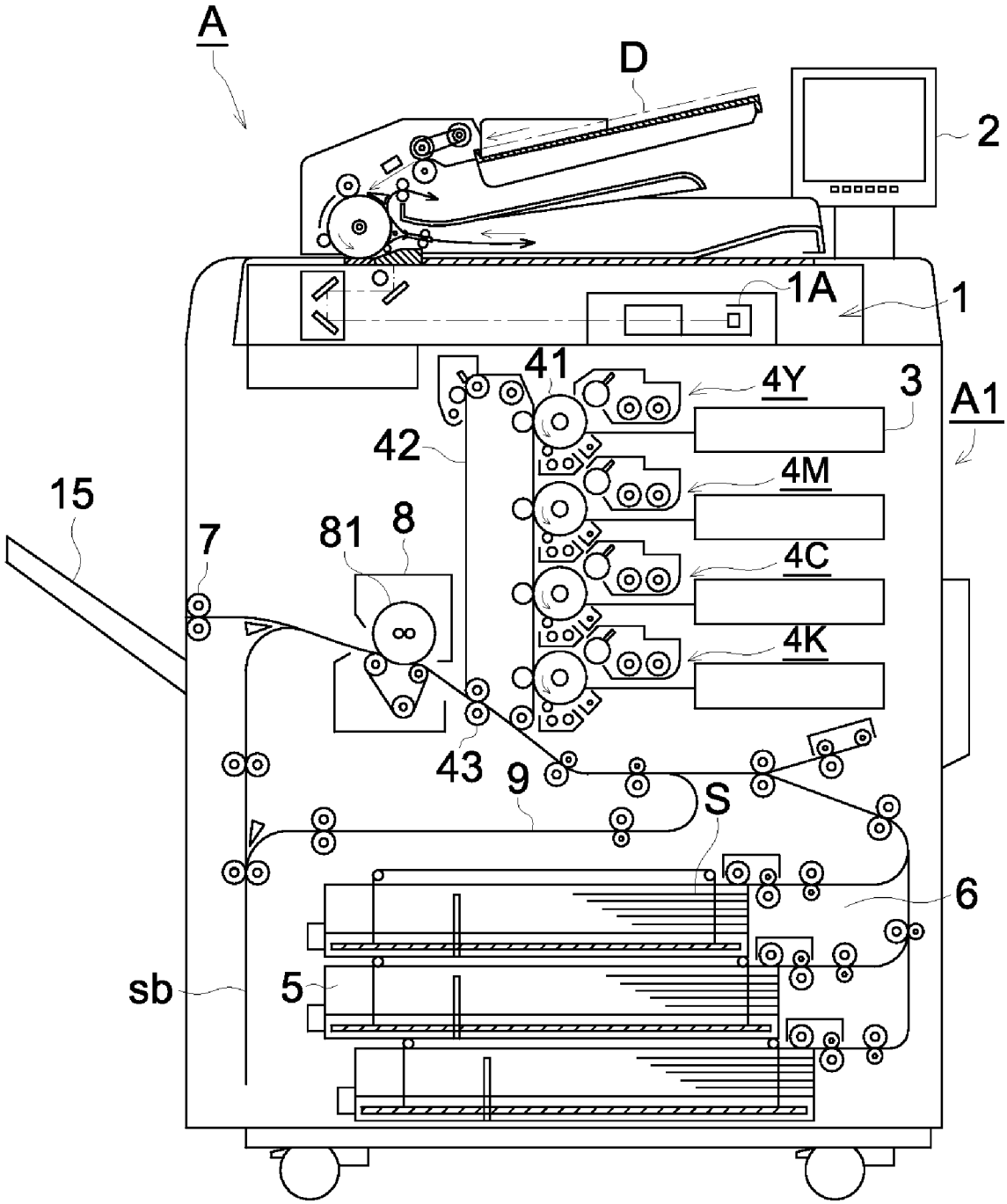
FIG. 1 is a middle cross-sectional diagram of an image forming apparatus relating to preferred embodiments.

FIG. 1 is a middle cross-sectional diagram of the image forming apparatus relating to the preferred embodiments. The image forming apparatus A is referred to as a tandem type color image forming apparatus and has an image forming device A1, a scanner section 1 an operation display section 2, and an auto document feeder D.

The image forming device A1 comprises a plurality of image forming sections, 4Y (Yellow), 4M (Magenta), 4C (Cyan), and 4K (black) image writing sections 3 (reference numerals for M, C and K are omitted), an intermediate image transfer belt 42, paper feed cassettes 5, a sheet feed conveyance section 6, a sheet delivery section 7, a fixing unit 8 and a double conveyance section 9. The fixing unit will be described in details later.

The image forming sections 4 (4Y, 4M, 4C, and 4K) comprises developing sections, each of the image forming sections includes two component developer formed of each color of small particle toner of Yellow (Y), Magenta (M), Cyan (C) and Black (K) and carrier.

The auto document feeder D is disposed on top of the image forming apparatus A. A document placed on a document table of the auto document feeder D is conveyed in a direction shown by an arrow and either of image on single side and image on both sides of the document is read by an optical system of the scanner 1 and read into CCD image sensor 1A.

Photoelectric converted analogue signal by the CCD image sensor 1A is subject to analogue processing, A/D conversion, shading compensation and image compression processing by a memory control section and then the signal is sent to the image writing section 3.

In the image writing sections 3, an output light from a semiconductor laser is irradiated on a photoreceptor drum 41 (references of M, C and K are omitted) and forms latent image. In the image forming sections 4, charging processing, exposing processing, developing processing transferring processing, cleaning and so on are carried out. Each color of toner image formed by the image forming sections 4 is sequentially transferred onto the rotating intermediate transfer belt 42 by a primary transfer section and thereby synthesized color image is formed.

The toner image on the intermediate transfer belt 42 is transferred by a secondary transfer roller 43 onto a sheet S conveyed from the sheet cassette 5 by the sheet supply conveyance section 6. The sheet S bearing the toner image is fixed image by being heated and pressured by fixing device 8, then ejected to the outside of the apparatus via sheet ejection section 7, and then stored on sheet tray 15.

The reference numeral 7 is a both side conveyance path. In case when image is formed on both side of the sheet S, image is formed on a first surface (front surface) of the sheet S and fixed by the fixing unit 8, then the sheet S conveyed to the both side conveyance section is turned front to back by a switch back path sb, then again conveyed to the image forming section 4, then image is formed on a second surface (back surface) of the sheet S, then the sheet S is ejected to the outside of the apparatus via sheet ejection section 7, and then stored on sheet tray 15

[Fixing Device 8]

Figure 2:
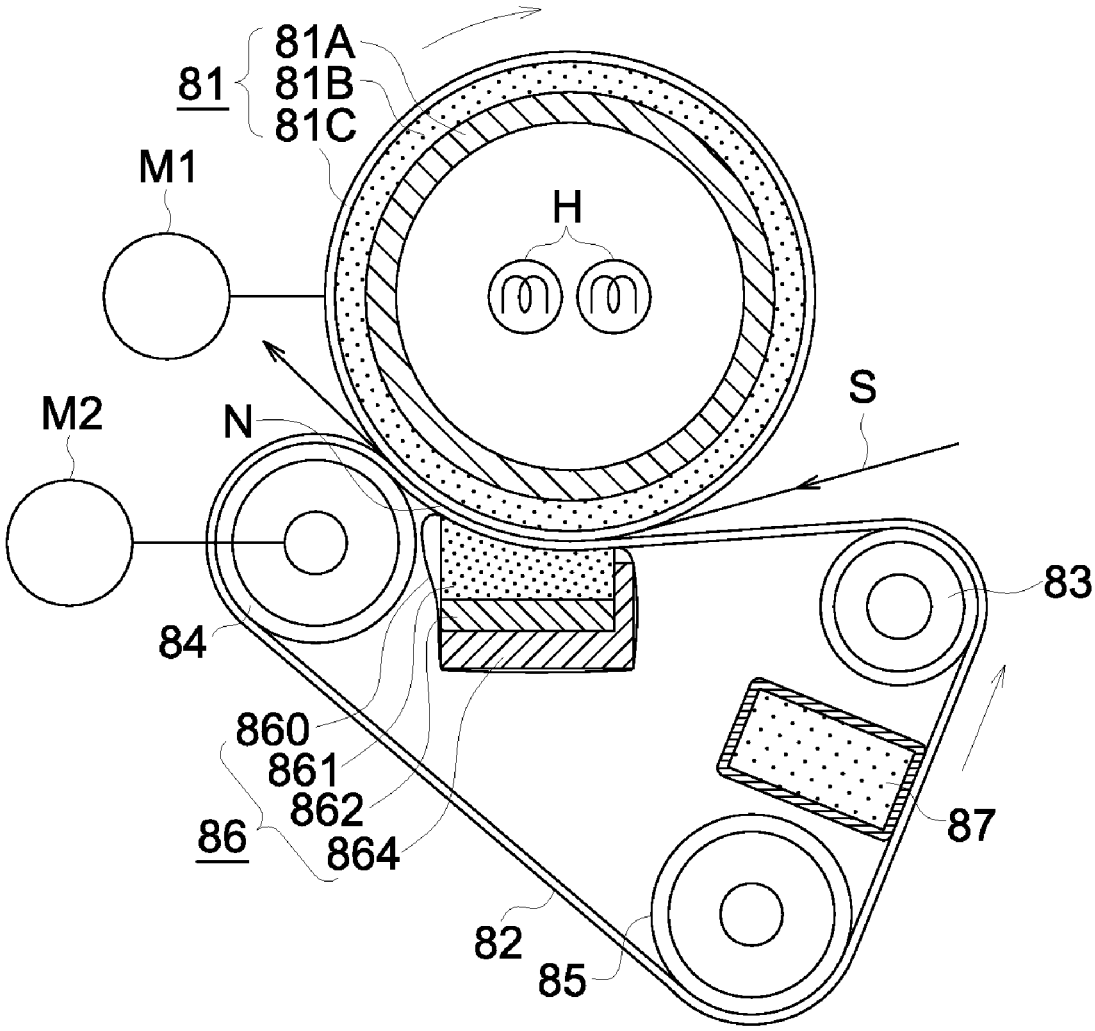
FIG. 2 is a middle cross-sectional diagram of a fixing device 8 of belt nip type.

Next, main configurations of the fixing device 8 of nip belt type relating to the preferred embodiment is described. FIG. 2 is a middle cross-sectional diagram of the fixing device 8 of belt nip type In the fixing device 8 relating to the present invention, a fixing nip portion N formed between a heat roller 81 (which can be called as fixing roller) heated by a halogen heater H and the fixing belt fixes the toner image on the sheet S onto the sheet S by applying heat and pressure. Here the heat roller 81 and the halogen heater function as a heating section, and the fixing belt 82 and a plurality of rollers around which the fixing belt is stretched function as a press section. The heating section and the press section pressingly contact with each other and thereby form the fixing nip section.

The heat roller 81 includes the halogen heater H as a heat source and comprises a cylindrical shaped core metal 81A, an elastic layer 81B made of HTV silicone rubber of a high thermal resistance and covering the cylindrical shaped core metal 81A, and in addition, a parting layer 81C made of fluoroplastic such as PFA (perfluoroalkoxy) or PTFE (polytetrafluoroethylene). In the preferred embodiment, an outer diameter of the heat roller 81 is formed as 65 mm in total, the cylindrical shaped core metal is made of aluminum of 7 mm thickness, the elastic layer 81B is made of the silicone rubber of 1.5 mm thickness, and the parting layer 81C is made of PFA tube of 30 μm thickness.

The fixing belt 82 comprises a base formed by polyimide with a thickness of 70 μm, an elastic layer with a thickness of 200 μm of silicon rubber and so on covering an outer surface of the base, and a parting layer within a thickness of 30 μm made of PFA or PTFE covering the elastic layer, and is formed in an endless shape.

The fixing belt 82 winds and stretches around each outer surface of a roller 83 near a part introducing the sheet S, a press roller 84 at a side outputting the sheet S, and a supporting roller 85 and contacts an outer peripheral surface of the heat roller 81.

The pressure roller 84 is a cylindrical shaped roller with an outer diameter of 23 mm of stainless steel and a length of 320 mm to 350 mm in a direction of ax, and presses toward the heat roller 81 with a load of 600N, for example.

The roller 85 is a roller called as steering roller and is configured that one side edge thereof swings and the shaft of the roller 85 inclines. Further a contact probe (not shown in drawings) which detects a position of an edge of the fixing belt 82 is provided at one of the edges of the fixing belt 82, and a control of stabilizing running of the fixing belt 82 is carried out by controlling the inclination of the roller 85 based on a detecting signal of the contact probe so that an meander position of the edge of the fixing belt 82 is limited within a predetermined range (also called as meander width $\alpha$).

[Pushing Section 86]

A pushing section comprises:

a pushing pad 861 as pushing material;

a holding member 862 for holding the pushing pad;

a compression spring 863 for applying a force to the holding member;

a holder 864 holding these parts; and a sliding sheet 860 which covers the pushing pad 861 and on which an inner peripheral surface of the fixing belt 82 slides (also called as slide-contacts).

The push section 86 which pushes the fixing belt 82 from inside thereof is provided near the upstream side of a roller 84 among rollers 83, 84, and 85 around which the fixing belt 82 stretches and forms a nip portion N by pressingly contacting the fixing belt 82 to a fixing roller 81 with press roller 84.

The pushing pad 861 is formed of heat-resisting rubber such as silicon rubber of 3 mm thickness with a hardness of JISA 10° to 30° and provided on the holding member 862 with a shape following along the curved shape of the heat roller 81. The holding member 862 is formed of stainless steel, for example. The pushing pad 861 forms a 20 mm width pad nip in a sheet feed direction by being pushed toward the heat roller 81 with a load of 500 N by the compression spring 863.

[Sliding Sheet 860]

The sliding sheet 860 is formed of 70 μm heat-resisting plastic such as polyimide, for example, and comprises a plurality of projections on a surface thereof. A method for forming the projections is an embossed molding, for example. The projections formed by the embossed molding are arranged at 0.5 mm to 1 mm intervals. Forming positions and heights of the projections will be described later. A lowering friction of the sliding sheet 860 with the inner peripheral surface of the fixing belt 82 is aimed by reducing contact dimension by disposing the projections. Further, through employing polyimide, there is an effective result of being strong and hardly torn off. The holder 864 is formed of stainless steel. The sliding sheet 860 covers the pushing pad 861 and is fixed to the holder 864. The sliding sheet 860 may be made as a cylindrical form and fixed and be fixed only at an upstream side, or may be made as a non-cylindrical form and be fixed at both the upstream side and the down stream side. The holder 864 is pushed via a supporting member by the compression spring 863.

[Lubricant Coating Member 87]

The lubricant coating member 87 is disposed at an upstream side of the press member 86 in the convey direction of the fixing belt 82 and the side of the inner peripheral surface of the fixing belt 82.

The lubricant coating member 87 is formed of felt such as aramid fiber. A lubricant reservoir is formed by filling an inside of a bug shape formed PTFE porous membrane with felt. The lubricant coating member 87 is impregnated with the lubricant in advance. The lubricant reservoir reserves the lubricant and coats the lubricant onto the inner peripheral surface of the fixing belt 82 through the PTFE porous membrane. As the lubricant, dimethyl silicon oil with viscosity of 100 to 1000 cs or methylphenyl silicon oil with viscosity of 100 to 1000 cs may be used.

In the fixing device configured as described above, the heat roller 81 is heated by the halogen heater H, driven by a motor M1 and thereby rotates in a clockwise direction as shown in the drawing. Further the pushing pad 861 is pushed via the holding member 862 by the compression spring 863 and thereby pushes the fixing belt 82 to the heat roller 81.

Therefore the fixing belt 82 rotates in a counterclockwise direction as shown in the drawing by the heat roller 81 which rotates in the clockwise direction driven by the motor M1, and the fixing nip portion with long length in a sheet conveyance direction is formed between a press section 80 (fixing belt unit) and the heat roller because the pushing pad 861 presses the fixing belt 82 to the heat roller 81 and is deformed elastically. Unfixed toner on the sheet S being conveyed is fixed by being applied heat and press force at the fixing nip section N.

The roller 84 at the outlet side rotates the fixing belt 82 driven by the motor M1. The rollers 83 and 85 rotate driven by the fixing belt 82.

Here the position relation of the sheet conveyance direction and the width direction vertical to the sheet conveyance direction (herein after called width direction or rotation shaft direction) is explained.

W1: maximum paper path width
W2: width of pushing pad 861
W3: width of fixing belt 82
W4: width of sliding sheet 860
W5: width of lubricant coating member 87
α: width of meander of fixing belt 82

Figure 3:
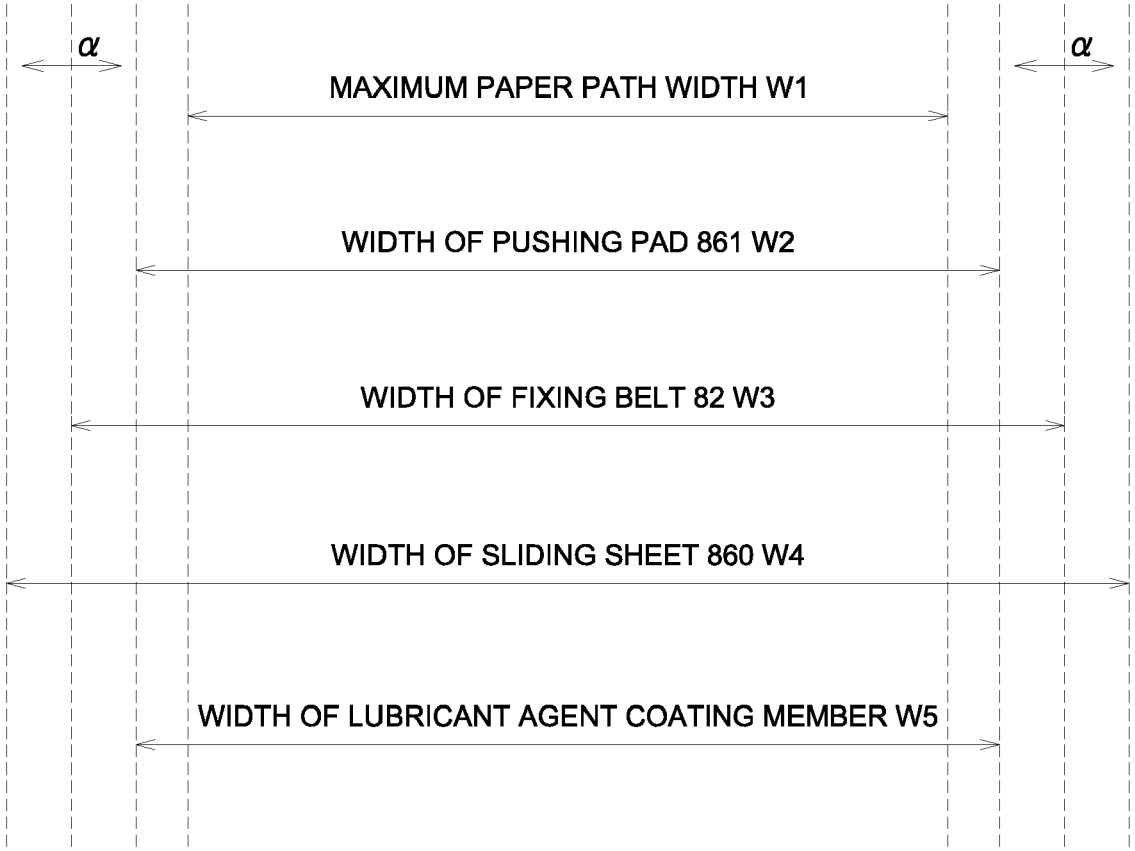
FIG. 3 is a drawing showing a relation of a position of each member in a width direction vertical to a sheet conveyance direction.

In FIG. 3, supposing widths of the above parts are W1 to W5, the above parts are set to satisfy the following relations:

$$W4>W3>W2>W1$$

$$W5\geqq W2$$

In order to prevent the lubricant coated inner peripheral surface of the fixing belt from seeping into an inner side from edges of the sliding sheet 860 and sticking to the pushing pad, W4 (width of sliding sheet 860) is set to be wider than W3 (width of fixing belt 82). In case when the lubricant sticks to the pushing pad 861, the pushing pad 861 will deform by swelling, be deformed by the predetermined force and cause problem such as wrinkles when the sheet is conveyed.

Further, because the following relations are set, even when the fixing belt 82 meander with a width of α, edges of the fixing belt 82 always position outside of the edges of pushing pad 861 and inside of the sliding sheet 860.

$$W4>W3+\alpha$$

$$W3-\alpha>W2$$

[First Area, Second Area]

Figure 4:
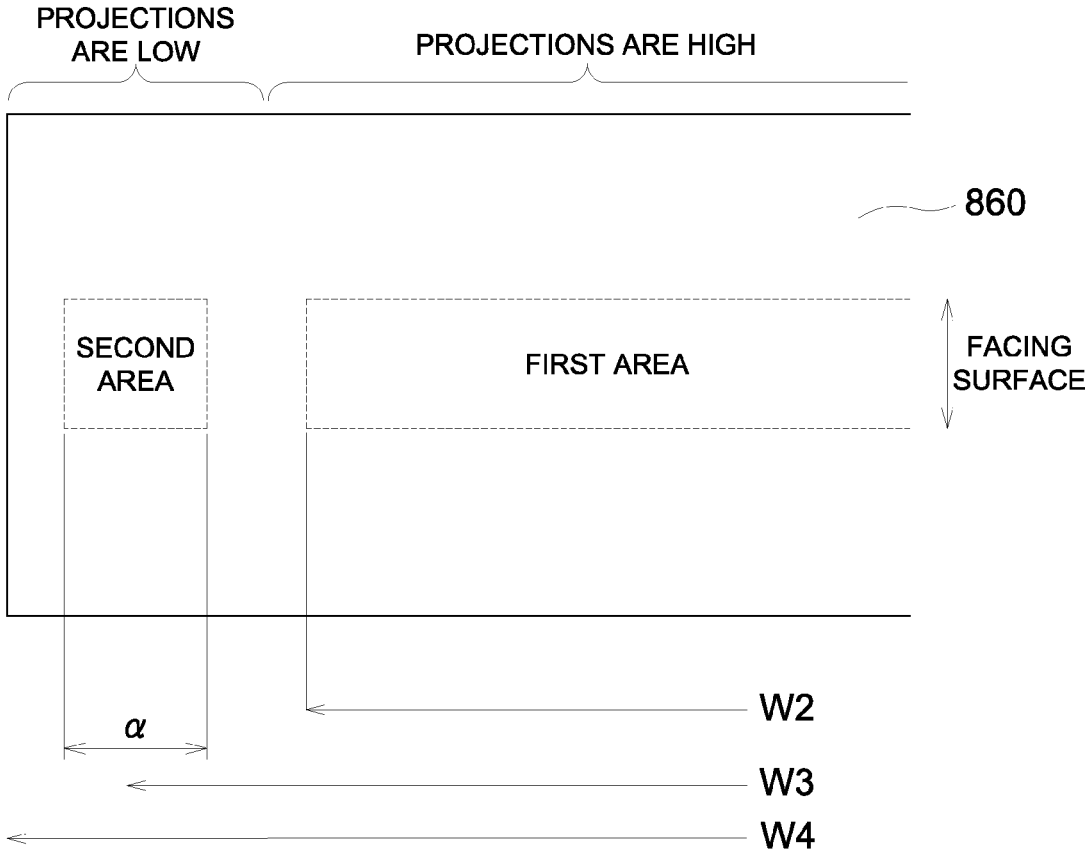
FIG. 4 is a development view of a sliding sheet 860.

FIG. 4 is a development view of a sliding sheet 860. The drawing shows an edge portion of only one side of width direction (one side of rotation shaft direction) and although the edge portion of the other side is not shown in the drawing, the edge of the other side is symmetrical to the one side.

A "first area" is an area of a surface of the sliding sheet 860 facing to the pushing pad 861, and locates inside of the edge in the width direction of the pushing pad when the sliding sheet 860 is fixed onto the pushing section 86, and is an area of sliding sheet 860 on which the inner peripheral surface of the fixing belt 82 slides.

A "second area" is an area near the edge of the fixing belt 82 where the sliding sheet contacts with the edge of the fixing belt 82 in the state where the sliding sheet 860 is fixed onto the pushing section 86. The second area spreads centering at the edge of the fixing belt 82 with a width of a in the rotation shaft direction in the state where the fixing belt 82 is fixed. The second area in a direction vertical to rotation shaft direction is an area where the sliding sheet 860 contacts with the fixing belt 82 and spreads equal to or a little longer than a length of the press pad 861.

Further a plurality of projections with a height h1 are provided at the first area of the sliding sheet 860 and a plurality of projection of projection of a height h2 are provided at the second area, wherein the height h2 of projections is lower than the height h1. The projections of the height h2 are provided on the whole outside area including the second area of the surface of the sliding sheet 860 of the preferred embodiment, and the projection of the height h1 are provided on whole inside area inner side of the outside area including the first area. The reason why the heights are different will be described as the flowing based on FIG. 5 and FIG. 6.

Figure 5:
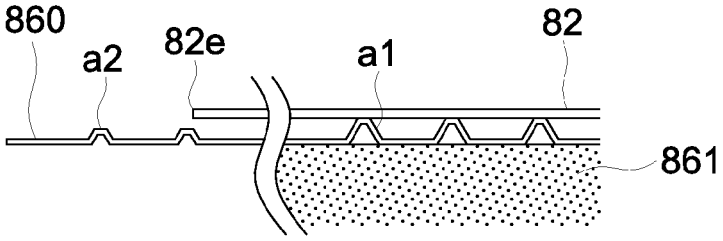
FIG. 5 is a cross-sectional diagram in the width direction around the sliding sheet 860 of the preferred embodiment.
Figure 6:
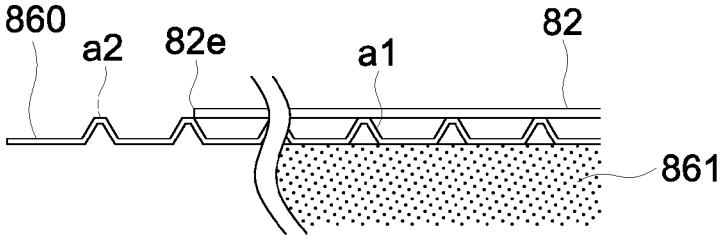
FIG. 6 is a cross-sectional diagram in the width direction around the sliding sheet 860 of a comparative embodiment.

FIG. 5 is a cross-sectional diagram in the width direction around the sliding sheet 860 of the preferred embodiment. FIG. 6 is a cross-sectional diagram in the width direction around the sliding sheet 860 of a comparative embodiment. As shown in FIG. 5, projections a1 have the height h1 and are provided in a reticular pattern of an equal interval from 0.5 mm to 1.0 mm in a surface direction. Each projection a1 has a cone shape of which top part is flat.

The height h1 is 0.2 mm for example and the projections are provided by embossing. The projections a2 have the height h2 which is lower than h1, 0.1 mm for example and have a similar shape to the projections a1.

In FIG. 5, the heights of the projections of the first area and the second area are different but the projections of an equal height are provided on the whole surface of the sliding sheet in the comparative embodiment of FIG. 6.

On the sliding sheet shown in FIG. 6, edges 82*e* of the fixing belt 82 and projections near the edges are easily worn out. The fixing belt 82 continuously swings in the rotation shaft direction because running of the fixing belt is controlled by steering the roller 85 so as to be stabilized. When the fixing belt moves from the central position toward a one end position on swinging the fixing belt 82, side faces facing toward the central position of the projections A2 are worn and easily abraded. When the abrasions progress, the sliding sheet are worn into a hole. Then the lubricant on the front surface side penetrates into the inner surface side then sticks to the pushing pad 861 and causes problems such as wrinkles at the conveying sheets by an affect of an oil swelling.

On the other hand, in the embodiment shown in FIG. 5, there is an advantage that the hole hardly occurs in the second area near the edge of the fixing belt 82 because the edges of the fixing belt and the projections a2 hardly graze each other and an abrasion is restrained as the height h2 of projections a2 is lower than the height h1 of the projections a1 of the first area.

Figure 7:
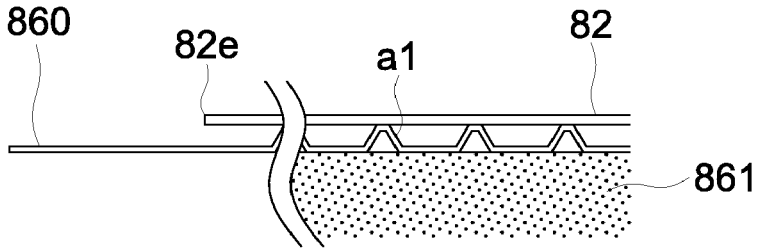
FIG. 7 is a cross-sectional diagram in the width direction around the sliding sheet 860 of another preferred embodiment.

FIG. 7 is a cross-sectional diagram in the width direction around the sliding sheet 860 of another preferred embodiment. Projections are not provided at the second area of the sliding sheet 860 shown in the drawing and the surface of the second area of the sliding sheet 860 is flat. The reason why the projections are originally provided at the surface of the sliding sheet 860 is because a reduction of abrasion is aimed by reducing a contacting area with the inner peripheral surface of the fixing belt 82. However it is not necessarily needed to provide projections near the edge 82*e* of the fixing belt 82 on the surface of the sliding sheet 860 to reduce the abrasions because the sliding sheet 860 does not receive a pushing force there from the pushing pad 861 and a friction force caused by sliding is small there. That is, as shown in FIG. 7, there are no problems for the fixing device having the sliding sheet 860 even if the projections are provided at the first area and the projections are not provided at the second area.

According to the preferred embodiments, it is possible to provide a fixing device which prevents a sliding sheet covering a press member which presses inner peripheral surface of the sliding sheet from being worn and torn by the friction.

Other Preferred Embodiment

As shown in FIGS. 1 to 5 and 8, the fixing device on only one side of which is provided the fixing belt 82 was explained. The invention is not limited to this, it may be a fixing device which comprises fixing belts and press members, provided both on the side of the heating section side and the side of the press section.

Figure 8:
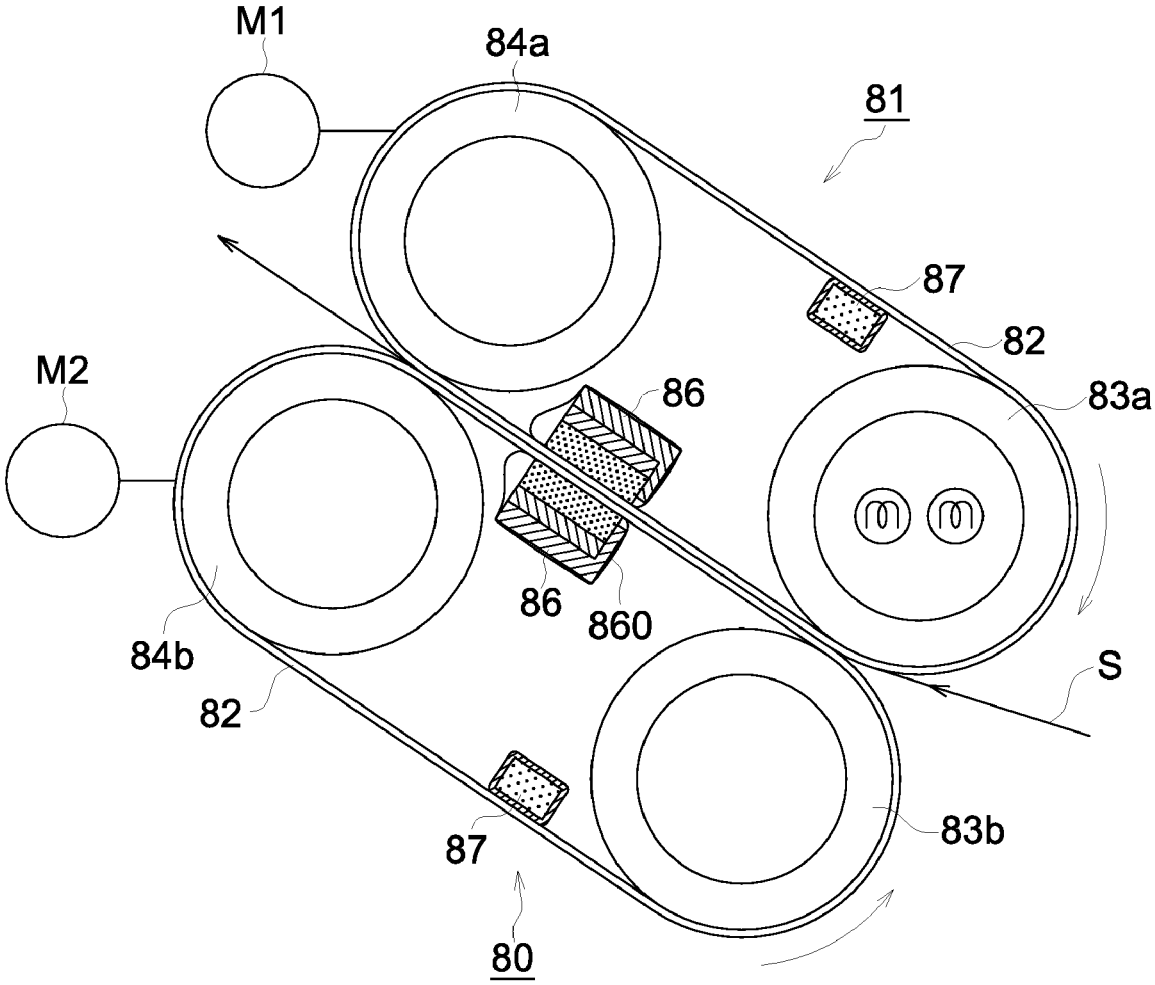
FIG. 8 is a diagram showing a fixing device in which each of a press section 80 and a heating section including a heating source comprises a fixing belt 82.

FIG. 8 is a preferred embodiment of a fixing device in which each of a press section 80 and a heating section including a heating source comprises a fixing belt 82. The fixing device comprises the sliding sheet shown either in FIG. 6 or in FIGS. 6 to 8, the pushing pad 861, and the lubricant coating member 87. The parts of FIG. 8 having same functions as FIGS. 1 to 7 are not explained but indicated by same references.

It is possible to provide a fixing device, wherein the sliding sheets are prevented from being worn and torn by the friction with the edges of the fixing belts 82, by configuring that the fixing device comprises the sliding sheets 860 shown in FIG. 6 and so on at both sides on the two fixing belts.

Example of Preferred Embodiment

An example of the preferred embodiment is explained next. In the embodiment, the image forming apparatus and the fixing device shown in the FIGS. 1 to 5 is used.

The height of the projections a1 of the sliding sheet 860 is 0.2 mm and each of the projections has a flat surface at the top of the cone shape, wherein an apex angle the cone is 90 degrees and an angle of the side (angle of generatrix with respect to a bottom side) is 45 degrees. The height h2 of the projections a2 is 0.1 mm and the projections a2 have similar shapes to the projections a1.

[Test Condition]

Evaluations of occurrences of edge tearing by conveying A4 sheets of 80 g/m2 with a speed of 80 prints/minute are carried out, using the fixing device of the preferred embodiments 1 to 3

[Test Result]

[List 1]

| print number (kp) | comparative example | Embodiment 1 |
|---|---|---|
| 100 | OK | OK |
| 150 | OK | OK |
| 200 | Torn | OK |
| 250 | | OK |
| 300 | | OK |

Evaluation level: Judging was made if the edge tearing of the sliding sheet occurs or no.

OK: Edge tearing has not occurred.

Torn: Edge tearing has occurred.

It has been observed that the print number to reach the edge tearing increases and there is an effective result of long life in the preferred embodiment. The edge tearing did not occur even when 300 k prints are conveyed in the preferred embodiment.

What is claimed is:

1. A fixing device comprising:

a heating section; and a press section which presses the heating section and thereby forms a fixing nip section, wherein at least one of the heating section and the press section comprises, an endless fixing belt;

a press member which presses the fixing belt from an inner peripheral surface of the fixing belt to the fixing nip; and a sliding sheet covering the press member, wherein the inner peripheral surface of the fixing belt slides on the sliding sheet and an edge part in a width direction of the sliding sheet locates out side of an edge part of the fixing belt in the width direction; a plurality of projections are provided at a first area which is inside of an edge part of the press member in the width direction of a surface of the sliding sheet; and a plurality of projections which are lower than the plurality of the projections provided at the first area are provided at a second area which is near the edge part of the fixing belt of the surface of the sliding sheet, or no projections are provided at the second area.

2. The fixing device according to claim 1, wherein the second area locates out side of an edge part of the press member in the width direction.

3. The fixing device according to claim 1, wherein lubricant is coated to the inner peripheral surface of the fixing belt.

4. The fixing device according to claim 3, further comprising a lubricant coating member which coats the lubricant to the inner peripheral surface of the fixing belt.

5. An image forming apparatus comprising:

an image forming section which forms a toner image on a sheet; and the fixing device according to claim 1 which fixes the toner image onto the recording sheet by applying heat and pressure.

* * * * *